US006200492B1

(12) United States Patent
Eicken et al.

(10) Patent No.: US 6,200,492 B1
(45) Date of Patent: Mar. 13, 2001

(54) TEXTILE LUBRICANTS WITH IMPROVED RESISTANCE TO SLINGING

(75) Inventors: Ulrich Eicken; Andreas Botulinski, both of Duesseldorf; Heidi Fiedler, Korschenbroich-Liedberg; Manfred Gorzinski, Duesseldorf, all of (DE); Issac Fleming, Charlotte, NC (US); Charles G. Dewitt, Matthews, NC (US); Jeffrey T. Langley, Charlotte, NC (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 08/175,172

(22) Filed: Dec. 29, 1993

Related U.S. Application Data

(63) Continuation of application No. 08/031,070, filed on Mar. 12, 1993, which is a continuation of application No. 07/808,053, filed on Dec. 12, 1991, now abandoned, which is a continuation of application No. 07/581,358, filed on Sep. 12, 1990, now abandoned.

(30) Foreign Application Priority Data

Nov. 30, 1989 (DE) ..... 39 39 549

(51) Int. Cl.[7] ..... D06M 15/19; D06M 15/263

(52) U.S. Cl. ..... 252/8.81; 252/8.84; 8/115.6

(58) Field of Search ..... 252/8.6, 8.8 R, 252/174.15, DIG. 2, 8.81, 8.84; 8/115.6

(56) References Cited

U.S. PATENT DOCUMENTS

| | | | | |
|---|---|---|---|---|
| 2,845,689 | | 8/1958 | Renold et al. | 28/80 |
| 3,444,090 | | 5/1969 | Michal | 252/312 |
| 3,529,990 | * | 9/1970 | Becker et al. | 252/8.6 |
| 3,788,888 | | 1/1974 | Kawanaka et al. | 117/139.5 |
| 3,977,979 | | 8/1976 | Crossfield et al. | 252/8.8 |
| 4,098,702 | | 7/1978 | Crossfield et al. | 252/8.6 |
| 4,098,703 | | 7/1978 | Crossfield et al. | 252/8.6 |
| 4,099,913 | * | 7/1978 | Walter et al. | 8/173 |
| 4,105,569 | * | 8/1978 | Crossfield | 252/8.6 |
| 4,303,456 | * | 12/1981 | Schmuck et al. | 156/78 |
| 4,434,008 | * | 2/1984 | Dumm et al. | 106/271 |
| 4,511,489 | * | 4/1985 | Reguejo et al. | 252/172 |
| 4,562,097 | * | 12/1985 | Walter et al. | 427/209 |
| 4,566,980 | * | 1/1986 | Smith | 252/8.6 |
| 4,767,556 | | 8/1988 | Childers et al. | 252/8.6 |
| 4,966,725 | * | 10/1990 | Singer et al. | 252/8.8 |
| 4,985,155 | * | 1/1991 | Yamada et al. | 252/8.6 |
| 4,990,267 | * | 2/1991 | Nickel et al. | 252/8.8 |
| 5,382,372 | * | 1/1995 | Eicken et al. | 252/8.81 |
| 5,490,943 | * | 2/1996 | Eicken et al. | 252/8.81 |

FOREIGN PATENT DOCUMENTS

| | | |
|---|---|---|
| 959204 | 12/1974 | (CA) . |
| 3830468 | 3/1990 | (DE) . |
| 127293 | 12/1984 | (EP) . |
| 261415 | 3/1988 | (EP) . |
| 758479 | 10/1956 | (GB) . |
| 1246134 | 9/1971 | (GB) . |

OTHER PUBLICATIONS

Principles of Polymer Chemistry (Cornell Univ. 1953), P.J. Flory, p. 313 (no month).

Die Angewandte Makromolekular Chemie, 178. Penzel & Goetz, p. 201–208 (1990) (no month).

B. Vollmert,—"Grundriss der makromolekularen Chemie" ("Outline of Macro–molecular Chemistry"), vol. III, pp. 55 ff (E. Vollmert Verlag, Karlsruhe, Federal Republic of Germany, 1988)—(no month).

* cited by examiner

*Primary Examiner*—Anthony Green

(74) *Attorney, Agent, or Firm*—John E. Drach; Steven J. Trzaska; Real J. Grandmaison

(57) ABSTRACT

Polymers that have limiting viscosities, measured in tetrahydrofuran at 20° C., of at least about 200 mL/g and that can be made by addition polymerization of a mixture of monomers containing:

A. from 100—about 30 wt % of esters of acrylic acid and methacrylic acid with monohydric saturated aliphatic alcohols which contain from 1–22 C atoms; and B. up to about 70 wt % of monomers selected from the group consisting of:

(1) unsaturated aliphatic carboxylic acids with 3–5 C atoms and their amides, (2) styrene and alkylstyrenes with 1–4 C atoms in their alkyl residues, (3) acrylonitrile, (4) vinyl esters of aliphatic $C_{1-18}$ carboxylic acids, and (5) amino substituted esters of acrylic acid and methacrylic acid with monohydric alcohols having from 2–6 carbon atoms are highly effective anti-sling additives for textile lubricants.

20 Claims, No Drawings

TEXTILE LUBRICANTS WITH IMPROVED RESISTANCE TO SLINGING

CROSS-REFERENCE TO RELATED APPLICATIONS

This application is a continuation of application Ser. No. 08/031,070 filed Mar. 12, 1993, and now abandoned, which was a continuation of application Ser. No. 07/808,053 filed Dec. 12, 1991 and now abandoned, which was a continuation of application Ser. No. 07/581,358 filed Sep. 12, 1990 and now abandoned.

FIELD OF THE INVENTION

This invention pertains to textile lubricants containing certain acrylate- and/or methacrylate-containing homo- and/or co-polymers, a process for producing textile lubricants containing these homo- and/or co-polymers, and the use of these homo- and/or co-polymers in textile lubricants to reduce the throwing off (usually called "slinging" in the art) of textile lubricants from the fiber surface during fiber manufacturing and/or processing.

DESCRIPTION OF RELATED ART

In the production of melt-spun chemical fibers, the first processing step immediately after the formation of the filaments is treatment of the fiber surface with materials called fiber preparations, which contain lubricants and anti-static agents as their principal active ingredients (cf., e.g., *Chemiefasern/Textil-Industrie* 1977, p. 328–335). It is generally known that without such a preparation, synthetic fibers cannot be practically produced or used in textile processing. A smoothing agent for the fiber surfaces is necessary, because the original surface of most polymeric fiber materials generates high frictional forces, so that as a result of the continuous contacts with, for example, guide devices during the manufacturing and processing steps, wearing away of the fibers takes place and can ultimately lead to filament or yarn breakage. In addition, polymeric filament materials generally absorb only a little water. Therefore they tend to develop electrostatic charges.

In the present state of the art, in fiber manufacture as well as in the further processing of the fibers, high-speed machines with thread speeds of up to 6,000 meters per minute ("m/min") are customary. At these high speeds, a considerable fraction of the applied textile lubricant often sprays or slings off. Not only does this slinging of the lubricants represent a waste, but also, as a result of the throwing off, it is practically impossible to consistently achieve the precise amount of lubricant desired for the individual process steps. In addition, the slinging also causes safety hazards, for example, slippery floors in the immediate vicinity of the machines, respiratory problems, and skin irritations due to spun-off droplets that disperse in the form of fine mists.

To reduce the slinging of textile lubricants during fiber manufacture and processing, it has been suggested many times that polymer compounds be added to the textile lubricants. For example it is known from European patents EP 261,415 and EP 127,293 that the use of high molecular weight polyisobutenes as well as the use of copolymers containing butenes in combination with $C_{5-20}$-alpha-olefins as monomeric constituents will reduce the slinging of spool oils during yarn processing.

U. S. Pat. 3,977,979 of Aug. 21, 1976 to Crossfield teaches that slinging off can be reduced by adding a hydrocarbon soluble, long molecular chain polymeric viscosity improver to an "otherwise conventional" finish formulation. Polymethacrylates, polyalkystyrenes, and polyisobutylenes are stated to be satisfactory, with the latter preferred and the only polymer type described in specific examples. along with hydrocarbon oils as the only base for the formulations. Closely related U.S. Pat. Nos. 4,098,702 and 4,908,703, both of Jul. 4, 1978, and 4,105,569 of Aug. 8, 1978, all of these patents being issued to Crossfield alone or with other inventors, have very similar teachings.

In all these Crossfield patents, the requirements for the polymeric viscosity index improving agents are specified primarily by molecular weight, for example polyisobutenes with molecular weights of between 20,000 and 2,000,000, polyalkylstyrenes with molecular weights of between 20,000 and 2,000,000, or polymethacrylates with molecular weights of between 300,000 and 800,000.

The weight average molecular weight of polymers ("$M_W$") is related to the intrinsic viscosity ("$\eta_i$") according to the equation $\eta_i=k(M_W)^{\alpha}$, where k and $\alpha$ are constants that depend on the temperature at and the solvent in which the intrinsic viscosity is determined and the particular type of homopolymer or copolymer being considered. Cf., e.g., P. J. Flory, *Principles of Polymer Chemistry* (Cornell University Press, Ithaca, N.Y., 1953), p. 313 and E. Penzel and N. Goetz, *Die Angewandte Makromolekular Chemie*, 178, p. 201–208 (1990).

However, these and other polymer anti-sling additives known from the state of the art can be incorporated only with difficulty into textile lubricants, because on one hand vigorous agitation is required for producing homogeneous polymer containing mixtures, while on the other hand vigorous agitation worsens the splashing behavior of textile lubricants. In addition, polyolefins do not dissolve in lubricants that contain carboxylic acid esters ("ester oils") as the principal lubricant components. Therefore, it is an object of this invention to provide, in particular, carboxylic acid ester based textile lubricants which, in comparison to known textile lubricants, have substantially improved adhesion properties on the fiber surface and thus are not thrown off at all, or only in very small quantities, at the high thread speeds customary today, and are also easy to produce.

DESCRIPTION OF THE INVENTION

In this description, except in the specific examples, the claims, and where otherwise explicitly stated to the contrary, all numbers denoting amounts of materials or conditions of manufacture or use are to be understood as modified in all instances by the term "about" in defining the broadest scope of the invention. Practice within the exact numerical limits specified is generally preferred. Also, where examples of ingredients suitable for particular purposes are given, unless otherwise explicitly stated, mixtures of the listed ingredients are as effective in the invention as single examples of the listed ingredients.

It has now been found that the above stated objects can be fulfilled if acrylate- and/or methacrylate containing homo- and/or co-polymers with limiting viscosities (alternatively called "intrinsic viscosities"), measured in tetrahydrofuran solvent at 20° C., of at least 200 milliliters per gram ("mL/g") are added to textile lubricants, particularly those based on esters of carboxylic acids.

Correspondingly, one embodiment of the invention includes textile lubricants, which may contain, for example, smoothing agents, emulsifiers, antistatics, and/or wetting agents, and which contain polymers that have limiting viscosities, measured in tetrahydrofuran at 20° C., of at least 200 mL/g, said polymers being constituted of the following monomeric units:

A. from 100–30 percent by weight ("wt %") of monomeric units derived from esters of acrylic acid and esters of methacrylic acid with monohydric saturated aliphatic alcohols, which may be straight chain, branched, and/or cyclic, and which contain from 1–22 C atoms; and B. up to 70 wt % of monomeric units derived from one or more of the following groups:
   1. unsaturated aliphatic carboxylic acids with 3–5 C atoms and their amides,
   2. styrene and/or alkylstyrenes with 1–4 C atoms in their alkyl residues,
   3. acrylonitrile,
   4. vinyl esters of aliphatic $C_{1-18}$ carboxylic acids, and
   5. amino substituted esters of acrylic acid and methacrylic acid with monohydric alcohols having from 2–6 carbon atoms.

An additional embodiment of the invention is a process for producing textile lubricants as specified above, in which method polymers as specified above are added in the form of aqueous dispersions to textile lubricant compositions as previously known in the art, under agitation at temperatures of between 15 and 80° C. under normal atmospheric pressure.

The limiting viscosity for the purposes of defining this invention is determined in accordance with the method described in B. Vollmert, *Grundriß der makromolekularen Chemie* (English translation of title is "Outline of Macromolecular Chemistry"), Vol. III, pp. 55 ff, (E. Vollmert Verlag, Karlsruhe, Federal Republic of Germany, 1988). In the case of copolymers, especially those containing more than 5 wt % ionic groups, the viscosity at high concentrations increases proportionally with the concentration, while at low concentrations, the viscosity decreases with increasing concentration. The limiting viscosities of these highly ionic copolymers are determined with the aid of graphs, in which the concentration is plotted on the abscissa and the viscosity on the ordinate, by extrapolating the section that is linear at high concentrations to zero concentration.

In copolymers that contain monomers from groups A and B, the content of monomers from group B is preferably a maximum of 60 wt %, based on the total quantity of monomer.

In accordance with the invention, monomers from group A with 1–18 carbon atom containing alcohols are preferred, and acrylic acid and/or methacrylic acid alkyl esters with alcohols containing 1–12 carbon atoms are more preferred. Esters from the group consisting of ethyl acrylate, n-butyl methacrylate, n-butyl acrylate, i-butyl methacrylate, n-hexyl methacrylate, ethylhexyl acrylate, and ethylhexyl methacrylate are particularly preferred.

Copolymers can be made up of monomeric acrylic acid and/or methacrylic acid aliphatic esters alone or in combination with one or more monomers from group B. Unsaturated aliphatic carboxylic acids with 3–5 C atoms, for example acrylic acid, methacrylic acid, and/or itaconic acid, are preferably used as group B monomers when group B monomers are used at all.

Homo- and/or copolymers with limiting viscosities, measured in tetrahydrofuran at 20° C., of at least 400 mL/g, or at least 600 mL/g, are more preferred and still more preferred, respectively.

The homo- and/or co-polymers to be used in accordance with the invention can be produced in a manner known generally in the art by emulsion polymerization in an inert gas atmosphere. The monomer or the monomer mixture may be dispersed in water containing anionic surfactant, and then the catalyst needed for polymerization may be added. The polymerization temperatures are preferably no more than 60° C., and more preferably, during the part of the reaction time that is characterized by an exothermic reaction, polymerization temperatures in the range of 25–35° C. To complete the polymerization reaction it may be advantageous to increase the reaction temperature to a maximum of 60° C. after the generation of heat of reaction during polymerization ceases.

Anionic surfactants suitable for use in the emulsion polymerizations include alkali and/or ammonium salts of (i) $C_{8-22}$ alkyl sulfonates, e.g., sodium lauryl sulfate; (ii) aryl sulfonates; (iii) alkylaryl sulfonates with 1–10 C atoms in the alkyl moieties, e.g., sodium octyl benzene sulfonate; (iv) $C_{8-22}$ alkyl sulfates and $C_{8-22}$ alkyl ether sulfates, e.g., the sodium salt of $C_{12/14}$ fatty alcohol+10 moles of ethylene oxide ("EO") sulfate; (v) $C_{8-22}$ alkyl sulfates; (vi) alkylphenol sulfates and alkylphenol ether sulfates with 1–10 C atoms in the alkyl residues, e.g., the sodium salt of i-nonylphenol·4 moles ("mol") EO sulfate; and (vii) sulfosuccinic acid mono- and di-esters and sulfosuccinic acid mono- and di-amides. Preferably used are alkali salts of sulfosuccinic acid derivatives that can be obtained according to known methods by reacting maleic anhydride with (i) straight chain, branched-chain or cyclic, possibly alkoxylated $C_{8-22}$ alkyl alcohols, (ii) alkyl phenols, alkoxylated or non-alkoxylated, or (iii) straight chain, branched, and/or cyclic, possibly alkoxylated $C_{8-22}$ alkyl amines, and subsequently reacting the product(s) of the initial reaction with alkali hydrogen sulfites or alkali sulfites. Examples of this preferred group which are particularly preferred include the sodium salts of (i) di-ethylhexylsulfosuccinate, (ii) $C_{12/14}$ fatty alcohol+3 mol EO sulfosuccinate, (iii) alkylaryl+9.5 mol EO sulfosuccinate, and (iv) N-substituted amides of sulfosuccinic acid in which the substituents are the mixture of alkyl groups corresponding to the acyl groups of natural coconut oil. Anionic surfactants are preferably used in quantities of between 1 and 15 wt %, more preferably in quantities between 3 and 10 wt %, in each case based on the total monomer mixture.

Catalysts (initiator systems) that may be used for emulsion polymerization, in particular, include the redox systems known from European application EP 48,084, for example (1) ammonium persulfate in combination with ascorbic acid or (2) ammonium persulfate or potassium persulfate in combination with sodium dithionite, sodium sulfite, or sodium thiosulfate. The initiator systems are preferably used in quantities of 0.05–0.8 wt %, more preferably in quantities of 0.1–0.5 wt %, in each case based on the total weight of monomer.

Under the usual conditions of emulsion polymerization, aqueous dispersions are obtained, which contain 5–40 wt % of the homo- and/or copolymers to be used in accordance with the invention. In textile lubricants, these homo- and/or co-polymers are preferably present in quantities of no more 2 wt % of actual polymer, based on the total weight of the lubricants. The term "textile lubricants" includes, in particular, the lubricants first applied to continuous filament yarns after these are extruded during the process of making them (these lubricants being sometimes called "spin finishes"), spin finishes for staple fiber processing, and lubricants for further yarn processing, for example coning oils and/or twisting oils.

Textile lubricants in accordance with the invention preferably contain:

30–97 wt % water-insoluble smoothing agents;

0.001–2 wt % acrylic acid- and/or methacrylic acid-alkyl ester-containing homo- and/or co-polymers with limiting viscosities, measured in tetrahydrofuran at 20° C., of at least 200 mL/g;

0.5–69.997 wt % water-soluble or water-dispersable smoothing agents, emulsifiers, antistatic agents, wetting agents and/or additives, for example pH regulators, thread closing agents, bactericides and/or anticorrosives; and 0.0015–67 wt % water.

Especially preferred are textile lubricants containing:

45–95 wt % water-insoluble smoothing agents;

0.001–0.5 wt % acrylic acid- and/or methacrylic acid alkyl ester-containing homo- and/or co-polymers with limiting viscosities, measured in tetrahydrofuran at 20° C., of at least 200 mL/g;

2–54.997 wt % water-soluble or water-dispersable smoothing agents, emulsifiers, antistatic agents, wetting agents and/or additives; and 0.0015–52 wt % water.

The textile lubricants in accordance with this invention may contain as smoothing agents, for example, mineral oils, carboxylic acid esters prepared from aliphatic carboxylic acids with 8–22 C atoms and straight- and/or branched chain, optionally alkoxylated, alkyl alcohols with 1–22 C atoms, for example isobutyl stearate, n-hexyl laurate, methyl palmitate, the 2-ethylhexyl ester of tallow fatty acid, coconut fatty acid triglycerides and/or trimethylolpropane-tripelargonate; silicones, for example, dimethylpolysiloxane; and/or polyalkylene glycols, for example, ethylene oxide/propylene oxide copolymers with average molecular weights between 600 and 6000. In the listing of suitable smoothing agents, no distinction is made between water insoluble smoothing agents and water soluble or water dispersable smoothing agents, since it is known to those skilled in the art that the water solubility of carboxylic acid esters containing alkoxylated alkyl alcohol residues as well as of polyalkylene glycols depends on the degree of alkoxylation and the alkylene oxides used.

Emulsifiers, wetting agents, and/or antistatic agents suitable for use include anionic, cationic, and/or nonionic surfactants, such as (i) mono- and/or di-glycerides, for example glycerin mono- and/or glycerin dioleate; (ii) alkoxylated, preferably ethoxylated and/or propoxylated, fats, oils, fatty alcohols with 8–24 C atoms, and $C_{8-18}$ alkylphenols, for example, castor oil, ethoxylated with 10–40 moles ethylene oxide (EO), and $C_{16-18}$ fatty alcohols, alkoxylated with ethylene oxide and/or propylene oxide, (iii) optionally alkoxylated $C_{8-24}$-fatty acid mono- and/or di-ethanolamides, for example, optionally ethoxylated oleic acid mono- and/or di-ethanolamide, the mono- and/or di-ethanolamide of fatty acid(s) having the same carbon skeleton as the alkanoyl groups in the triglycerides found in natural coconut oil, and tallow fatty acid mono- and/or di-ethanolamide; (iv) alkali and/or ammonium sulfonates of, optionally alkoxylated, $C_{8-22}$ alkyl alcohols, $C_{8-22}$ alkenyl alcohols, and aromatic alcohols; (v) reaction products of, optionally alkoxylated, $C_{4-2}$ alkyl alcohols with phosphorus pentoxide or phosphorus oxychloride in the form of their alkali, ammonium, or amine salts, for example phosphoric acid esters of optionally ethoxylated $C_{12/14}$ fatty alcohols; (vi) alkali and/or ammonium salts of $C_{8-22}$ alkylsulfosuccinates, for example, sodium dioctylsulfosuccinate; and (vii) amine oxides, for example dimethyldodecylamine oxide.

The textile lubricants in accordance with the invention may contain as additives thread closure agents, e.g., fatty acid sarcosides and/or copolymers with maleic anhydride and/or polyurethanes as taught in DE 3,830,468; pH value regulators such as aliphatic $C_{1-22}$ carboxylic acids and/or $C_{1-4}$ hydroxycarboxylic acids, such as acetic acid, glycolic acid and/or oleic acid, alkali hydroxides such as potassium hydroxide, and/or amines such as triethanolamine; bactericides; and/or anticorrosives.

Water-soluble and/or water-dispersable smoothing agents, emulsifiers, antistatic agents, wetting agents, and/or additives can be used in any mixing ratio to one another in the textile lubricants in accordance with the invention. Usually, however, the content of additives in textile lubricants does not exceed 10 wt %.

The incorporation of acrylate- and/or methacrylate containing homo- and/or co-polymers with limiting viscosities, measured in tetrahydrofuran at 20° C., of at least 200 mL/g, existing in the form of aqueous dispersions, into textile lubricants is accomplished in accordance with one embodiment of the invention by adding the polymer dispersions to textile lubricants under agitation at temperatures of between 15 and 80° C. under normal atmospheric pressure. From the beginning of addition of the polymers, they are usually dispersed homogeneously in the lubricants in the form of very small particles. To accelerate untangling and unfolding of the polymer particles, so as to produce the equilibrium conformations of the polymer molecules within the lubricants according to this invention, it may be advantageous to heat the lubricants to 40–100° C., if desired without agitation. If desired, the water content of the lubricants obtained in accordance with such a process embodiment of the invention can be reduced by distillation.

The application of textile lubricants according to the invention to the textiles to be lubricated may take place in a known manner, for example with the aid of application rollers or metering pumps. The quantity of spinning preparations or lubricants applied for further processing, in undiluted form or in the form of aqueous emulsions, is preferably between 0.05 and 5 wt % of active substance, relative to the weight of the fiber material. Fiber materials consisting, for example, of polyester, polyamide, polypropylene, and/or polyacrylate can be treated with the textile lubricants in accordance with the invention.

The textile lubricants in accordance with the invention normally are liquid and show filament formation when a glass rod dipped into undiluted textile lubricant at 20° C. is pulled out again. In comparison to the known polymer containing textile lubricants with already improved anti-sling behavior, during the manufacturing and/or processing of fibers, the adhesion to the fiber surface and thus the sling behavior are distinctly improved when textile lubricants in accordance with the invention are used.

Acrylate- and/or methacrylate-containing homo- and/or co-polymers with limiting viscosities, measured in tetrahydrofuran at 20° C., of at least 200 mL/g can be incorporated in textile lubricants without difficulty. In comparison to the polyolefins customarily used, the polymers in accordance with the invention have the advantage that they are also soluble in the carboxylic acid ester-containing lubricants that are favored on the basis of environmental considerations.

One particularly preferred embodiment of conventional textile lubricants contains a silicone polymer to lower surface tension and an alkali metal hydroxide, most preferably potassium hydroxide, in a sufficient amount to neutralize any acid component of the lubricant, as a corrosion inhibitor that also contributes some anti-static properties to the lubricant. It was found that when anti-sling polymers as described above were added to this particular type of conventional lubricant, haziness or even precipitation of solids usually occurred, even though the other ingredients were compatible with one another in the absence of silicones. However, it was found that this difficulty could be overcome by adding to the composition a component of one or more amines with a Hydrophilic/Lipophilic Balance ("HLB") number of not more than 8, preferably of not more than 5.7. A particularly preferred amine mixture may be made by condensing tallow amines with an average of 2 moles of ethylene oxide per mole of amine; this mixture is designated hereinafter as "TAM-2".

If desired, an amine component of the type described above may be substituted for the alkali metal hydroxide, but often it is advantageous to use both components. The amount of amine component added should preferably be sufficient to prevent any undesirable degree of hazing and should definitely be sufficient to prevent any gross separation of the composition into two or more phases, with one settling below the other due to the influence of gravity. The total amount of basic materials present, including the amine and any alkali metal hydroxides that may be present, should be jointly sufficient to neutralize any acidic materials present in the total lubricant composition.

Accordingly, one particularly preferred embodiment of the invention is a textile lubricant containing (i) at least 0.02, preferably at least 0.05, more preferably at least 0.09 wt % of a silicone component having a viscosity at room temperature in the range from 5 to 70 centistokes, preferably from 10 to 54 centistokes, more preferably from 20 to 50 centistokes, said silicon component consisting essentially of one or more silicone homopolymers and/or silicone and oxyethylene and/or oxypropylene copolymers having molecular structures conforming to the general chemical formula:

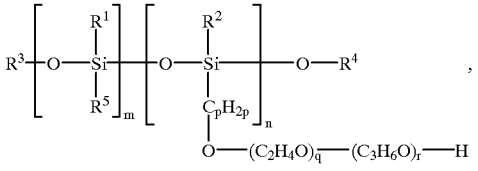

wherein each of $R^1$, $R^2$, $R^3$, $R^4$, and $R^5$ is a monovalent alkyl moiety having from 1 to 18, preferably 1, carbon atoms; m is a positive integer; p is 2 or 3; each of n, q, and r independently is zero or a positive integer; and each of the molecular blocks having the subscripts m, n, q, and r may be repeated, optionally with different values for the subscripts, in the actual structure of each polymer molecule, with the blocks having the subscripts m and n optionally being randomly intermixed with each other in the backbone of the polymer and the blocks having the subscripts q and r optionally being randomly intermixed with each other in one or more of any polyether side chains that may exist in an individual polymer molecule within the component; (ii) a sufficient amount of an amine component consisting essentially of one or more amines having an HLB value of not more than 8 to prevent any visually detectable gravitational segregation of two or more liquid phases in the total lubricant composition; and (iii) a sufficient amount of total basic constituents to at least neutralize any acidic ingredients present. The amount of component (ii) is increasingly preferably at least 0.5, 1, and 2.8 wt %. These particularly preferred embodiments may contain other optional ingredients, and must contain at least the other necessary ingredients already specified above. A particularly common and often preferred optional ingredient in these compositions is a partially esterified phosphoric acid, such as the mono- and/or di-octyl esters of phosphoric acid. If such partially esterified phosphoric acid(s) are included, preferably their amount is at least 0.5, or more preferably at least 1, wt % of the total lubricant.

The practice of this invention may be further appreciated by consideration of the following specific examples and comparison examples.

EXAMPLES

1. Preparation of Acrylate- and/or Methacrylate Containing Homo- and/or Co-polymers

Examples 1.1–1.9

Into a stirred reactor, consisting of a four-neck flask provided with an agitator, a thermometer, two dropping funnels, and a nitrogen inlet, 400 grams ("g") of deionized water, 6.7 g of Disponil™ SUS 875 (a 75% aqueous solution of the sodium salt of di(ethylhexyl)sulfosuccinate, commercially available from Henkel KGaA, Düsseldorf, Federal Republic of Germany) and 100 g of monomer were introduced. Into one dropping funnel was placed 0.1 g of ammonium persulfate, dissolved in 3 mL water, and in the other dropping funnel, 0.15 g of ascorbic acid, dissolved in 3 mL water. Then the apparatus was deaerated. During polymerization, a nitrogen stream was passed through the apparatus. First the aqueous, ammonium persulfate containing solution and then the aqueous, ascorbic acid containing solution were dropped into the monomer-containing, aqueous mixture, which had been pre-heated to about 28° C. During the polymerization reaction, which took place exothermally for about 2 hours ("hr"), a temperature of 35° C. was not exceeded. After 2 hr, 0.05 g ammonium persulfate, dissolved in 3 mL water, and 0.075 g ascorbic acid, dissolved in 3 mL water, were added in succession, and polymerization continued for 1 hr at 60° C. Coagulate-free emulsions containing 20 wt % of polymer solids were obtained.

The monomers used as well as the limiting viscosities of the homo- and co-polymers 1.1 to 1.9 obtained are shown in Table 1.

TABLE 1

MONOMER COMPOSITIONS AND LIMITING VISCOSITIES FOR EXAMPLES 1.1–1.9 AND 2.1–2.2

| Example No. | Monomer Composition | Limiting Viscosity in mL/g[1] |
|---|---|---|
| 1.1 | n-Butylmethacrylate[2] | 1210 |
| 1.2 | n-Hexylmethacrylate[3] | 840 |
| 1.3 | Ethylhexylmethacrylate | 975 |
| 1.4 | 85 wt % Ethylhexylacrylate, 10 wt % methyl methacrylate, and 5 wt % methacrylic acid | 785 |
| 1.5 | 85 wt % Ethylhexylmethacrylate, 10 wt % methyl methacrylate, and 5 wt % methacrylic acid | 670 |
| 1.6 | 85 wt % Ethylhexylacrylate and 15 wt % methyl methacrylate | 855 |
| 1.7 | 97.5 wt % Ethylhexylmethacrylate and 2.5 wt % methacrylic acid | 985 |

TABLE 1-continued

MONOMER COMPOSITIONS AND LIMITING VISCOSITIES FOR EXAMPLES 1.1–1.9 AND 2.1–2.2

| Example No. | Monomer Composition | Limiting Viscosity in mL/g[1] |
|---|---|---|
| 1.8 | 95 wt % n-Butylmethacrylate and 5 wt % methacrylic acid | 870 |
| 1.9 | 80 wt % n-Butylmethacrylate and 20 wt % methacrylic acid | 670 |
| 2.1 | 60 wt % ethyl acrylate and 40 wt % methacrylic acid | 350 |
| 2.2 | 40 wt % ethyl acrylate and 60 wt % methacrylic acid | 400 |
| 2.3 | 55 wt % ethyl acrylate, 35 wt % methacrylic acid, and 10 wt % acrylic acid | 455 |

Notes for Table 1

[1]Measured in tetrahydrofuran at 20° C.

[2]Weight-average molecular weight determined viscometrically in methyl ethyl ketone at 23° C. was $10.8 \cdot 10^6$ (cf J. Polymer Sci. 25, p 413 {1957}).

[3]Weight-average molecular weight determined viscometrically in methyl ethyl ketone at 23° C. was $9.8 \cdot 10^6$ (cf J. Polymer Sci. 21, p 417 {1956}).

Example 2.1–2.3

Into a stirred reactor, consisting of a three-neck flask with agitator, thermometer, dropping funnel, and a nitrogen inlet, were placed 388 g of deionized water, 8.3 g Disponil™ SUS 90 (a 30% aqueous solution of sodium alkylaryl+9.5 EO sulfosuccinate, commercially available from Henkel KGaA, Düsseldorf, Federal Republic of Germany),8.3 g of a 30% aqueous solution of the sodium salt of $C_{12-14}$ fatty alcohol+10 EO sulfate, and 100 g of a monomer mixture. After all the other ingredients had been added, 0.1 g of ammonium persulfate was added to the apparatus flask. Into the dropping funnel were placed 0.15 g of ascorbic acid, dissolved in 1 mL water. Then the apparatus was deaerated. During the polymerization, a nitrogen stream was passed through the apparatus. The aqueous ascorbic acid containing solution was dropped into the monomer and persulfate containing aqueous mixture, which had been preheated to about 29° C. During the exothermic part of the polymerization reaction, which took about 1 hr, a temperature of 30° C. was not exceeded. Then the polymerization was continued for 1 hr at 60° C. under agitation. Coagulate-free emulsion containing 20 wt % of polymer were obtained.

The monomers used as well as the limiting viscosity of each of the copolymers 2.1–2.3 obtained are shown in Table 1.

2. Preparation and Application of Textile Lubricants

Example A

To 995 g of a textile lubricant, consisting of 78.5 wt % of iso-butyl stearate, 5 wt % of oleyl/cetyl alcohol+5 mol EO, 2.2 wt % coconut fatty acid monoethanolamide+4 mol EO, 0.8 wt % of oleic acid, 6 wt % of a commercial secondary fatty alcohol+3 mol EO surfactant (Tergitol™ 15S3, manufactured by Union Carbide), 6 wt % of a secondary fatty alcohol+7 mol EO surfactant (Tergitol™ 15S7, manufactured by Union Carbide), and 1.5 wt % water, 5 g of the polymer emulsion prepared according to example 1.2 was added under agitation at maximum speed of a mixing vessel with a propeller agitator and at a temperature of 20° C. After 30 seconds ("sec"), the polymer emulsion had become uniformly distributed, and a clear solution had formed. Then the agitation speed was reduced as far as possible without stopping and the textile lubricant was heated to 60° C. to accelerate untangling and unfolding of the polymer particles.

The lubricant obtained was applied as spool oil to a textured polyester yarn at a rate of 1.5 wt %. At the first point after the lubricant application at which the fiber bundle changed direction, the amount of lubricant sprayed off was collected and weighed. In comparison to the lubricant without polymer addition, the amount of polymer containing lubricant sprayed off was reduced by 82%.

Example B

In the same manner as in Example A, a polymer containing lubricant was prepared from 995 g of a lubricant consisting of 85 wt % of n-hexyl laurate, 6 wt % of the monoethanolamine salt of a mixture of mono- and di-esters of phosphoric acid with lauryl alcohol+6 mol EO, 4 wt % of a secondary fatty alcohol+3 mol EO surfactant, and 5 wt % of a secondary fatty alcohol+7 mol EO surfactant, along with 5 g of a polymer emulsion prepared according to example 1.3.

The lubricant obtained was applied as spooling oil, during spool-to-spool transfer, to a polyamide yarn at a rate of 1 wt %. At the first point after lubricant application at which the fiber bundle changed travel direction, the slung-off quantity was collected and weighed. In comparison to the same lubricant without polymer added, a 94% reduction of the quantity slung off was obtained with the polymer containing lubricant.

Example C

In the same manner as in Example A, a polymer containing lubricant was prepared from 995 g of a lubricant consisting of 55 wt % of trimethylolpropane tripelargonate, 10 wt % of the sodium salt of an arylsulfonate, 6 wt % of oleic acid, 2 wt % of triethanolamine, 15 wt % of oleyl/cetyl alcohol+5 mol EO, 6 wt % of castor oil+30 mol EO, and 6 wt % of water, and 5 g of a polymer emulsion prepared according to example 1.7.

An amount of 100 g of the polymer containing lubricant was introduced into 900 g of water, and the emulsion obtained was applied, immediately after spinning, to a polyester yarn at a rate of 1.5 wt %. At the first point following lubricant application at which the fiber bundle changed travel direction, the slung off amount was collected and weighed. In comparison to the same lubricant without polymer added, a 33% reduction of the quantity slung off was obtained with the polymer-containing lubricant.

Example D

In the same manner as in Example A, a polymer containing lubricant was prepared from 995 g of a lubricant consisting of 60 wt % of iso-butyl stearate, 10 wt % of oleic acid, 8 wt % of mixture of mono- and di-lauryl phosphates, 5 wt % of a commercial secondary fatty alcohol+9 mol EO surfactant (Tergitol™ 15S9, manufactured by Union Carbide), 4 wt % of sodium dioctylsulfosuccinate, 6 wt % of oleyl/cetyl alcohol+5 mol EO, and 7 wt % of a 47 wt % potassium hydroxide aqueous solution, plus 5 g of a polymer emulsion prepared according to example 1.8.

From this polymer containing lubricant, a 15 wt % aqueous emulsion was prepared by mixing 150 g of this lubricant into 850 g water. The emulsion obtained was applied, immediately after spinning, to a polyester yarn at a rate of 1.5 wt %. At the first point after lubricant application at which the fiber bundle changed travel direction, the sprayed-off amount was collected and weighed. In comparison to the same lubricant without polymer addition, a 38% reduction of the sprayed-off quantity was obtained with the polymer-containing lubricant.

Example E

The base lubricant for this example contained 39.09 wt % of esters of pelargonic acid with alcohols made by condensing methanol with an average of 400 moles of EO per mole of methanol, 30.75 wt % of the diethanol amine ("DEA") salt of octyl decyl phosphate, 6.79 % of alcohols made by condensing the natural mix of $C_{12-18}$ alcohols derived from with an average of 9 mol of EO per mol of alcohol, and the balance water. An amount of the emulsion prepared according to Example 1.9 above, equal to 1 wt % of the base lubricant, was added to a sample of the base lubricant, and the mixture allowed to stand for 24 hr. The mixture was then clear to slightly hazy and suitable for use as a sling-resistant textile lubricant, with excellent lubricating effect.

Example F

The base lubricant for this example contained 48.8 wt % of $C_{8-10}$ fatty acids condensed with an average of 9 mol of EO per mole of acid, 14.3 wt % of fatty acids derived from hydrogenated coconut oil and then condensed with an average of 9 mol of EO per mole of acid, 16.1 % of esters of lauric acid with alcohols made by condensing methanol with an average of 385 mol EO per mol of methanol, 10.1 wt % of mono- and di-esters of phosphoric acid with alcohols made by condensing tridecyl alcohol with an average of 6 mol of EO per mole of alcohol, 2.7 wt % of triethanolamine, and the balance water. An amount of the emulsion prepared according to Example 1.9 above, equal to 1 wt % of the base lubricant, was added to a sample of the base lubricant, and the mixture allowed to stand for 24 hr. The mixture was then completely clear and suitable for use as a sling-resistant textile lubricant, with excellent lubricating effect.

Example G

For this example the base lubricant consisted entirely of esters of pelargonic acid with alcohols made by condensing methanol with an average of 400 moles of EO per mole of methanol. An amount of the emulsion prepared according to Example 1.9 above, equal to 1 wt % of the base lubricant, was added to a sample of the base lubricant, and the mixture allowed to stand for 24 hr. The mixture was then completely clear and suitable for use as a sling-resistant textile lubricant, with excellent lubricating effect.

Example H

For this example, the base lubricant consisted entirely of liquid oligomers of 1-decene. To prepare the lubricant according to the invention, a sample of the base lubricant was mixed with about 10 wt % of 2-propanol and 1 wt % of the emulsion prepared according to Example 1.9 above. This mixture was then heated sufficiently to remove substantially all of the 2-propanol and water (from the emulsion). The mixture was then completely clear and suitable for use as a sling-resistant textile lubricant, with excellent lubricating effect.

Example I

For this example the base lubricant consisted of 66.0 wt % of butyl stearate, 3.9 % of polyether alcohols made by condensing an average of 9 moles of propylene oxide ("PO") followed by condensing an average of 5.5 moles of EO with commercial grade $C_{16-18}$ fatty alcohols, 10.4 wt % of potassium salts of mixed mono- and di-esters of phosphoric acid with hexanol, 4.9 wt % of the product of condensing nonyl phenol with an average of 6 mol EO per mole of phenol, 9.7 wt % of oleic acid, 2.9 wt % of the sodium salt of dioctyl sulfosuccinate, and 2.2 wt % of 45 % aqueous potassium hydroxide. An amount of the emulsion prepared according to Example 1.3 above, equal to 1 wt % of the base lubricant, was added to a sample of the base lubricant, and the mixture allowed to stand for 24 hr. The mixture was then completely clear and suitable for use as a sling-resistant textile lubricant, with excellent lubricating effect.

Example J

For this example the base lubricant consisted of 87.25 wt % of mineral oil, 3.00 wt % of the product of condensing nonyl phenol with an average of 6 mol EO per mole of phenol, 6.00 wt % of mixed alcohol-ethers prepared by condensing a naturally derived mixture of $C_{12-14}$ alcohols with an average of 3 mol of EO per mol of alcohol, 2.00 wt % of a product of condensing iso-oleic acid with an average of 400 mol of EO per mole of acid, 1.25 wt % of oleic acid, and 0.50 wt % water. An amount of the emulsion prepared according to Example 1.3 above, equal to 1 wt % of the base lubricant, was added to a sample of the base lubricant, and the mixture allowed to stand for 24 hr. The mixture was then completely clear and suitable for use as a sling-resistant textile lubricant, with excellent lubricating effect.

Example K

The base lubricant for this example consisted of 65.5 wt % of poly{ethylene glycol} having an average number of 400 monomer units per polymer molecule, 34.4 wt % of fatty acids derived from natural coconut oil. and 0.1 wt % of 85% aqueous phosphoric acid. An amount of the emulsion prepared according to Example 1.9 above, equal to 1 wt % of the base lubricant, was added to a sample of the base lubricant, and the mixture allowed to stand for 24 hr. The mixture was then completely clear and suitable for use as a sling-resistant textile lubricant, with excellent lubricating effect.

Example L

For this example, the initial lubricant consisted of 74.35 wt % of methyl esters of the mixture of fatty acids obtained from natural tallow, 1.14 % of mixed mono- and di-iso-octyl esters of phosphoric acid, 10.63 wt % of mixed alcohol-ethers prepared by condensing a commercial grade mixture of $C_{12-14}$ fatty alcohols with an average of 3 mol of EO per mol of alcohol, 6.37 wt % of polyether alcohols made by condensing an average of 9 moles of PO followed by condensing an average of 5.5 moles of EO with commercial grade C16-18 fatty alcohols, 2.00 wt % of esters of iso-oleic acid, 1.25 wt % of oleic acid, 0.10 wt % of a commercial dimethyl silicone polymer fluid with a viscosity of 50 centistokes ("cst"), 0.86 wt % of a 45 wt % solution of potassium hydroxide in water, 3.00 wt % of a mixture of etherified amines made by condensing the mixture of amines corresponding to the mixture of fatty acids in natural tallow with an average of 2 mol of EO per mole of amine, and 0.30 wt % of the emulsion prepared in Example 1.3 above. This initial mixture was slightly hazy, but the haze was virtually eliminated by the addition of 0.3 wt % of water to the initial mixture to produce the final lubricant for this example. It was a high quality, sling resistant lubricant.

Example M

The composition for this example was the same as for the initial composition of Example L, except that commercial grade iso-butyl stearate was substituted for the mixture of methyl esters that made up the major component of Example L. This composition was a clear, high quality, sling-resistant lubricant without the need for any addition of water such as was used in Example L.

Example M-2

The composition for this example was the same as for Example M, except that mixed esters of $C_{8-10}$ alcohols with $C_{8-10}$ fatty acids replaced the iso-butyl stearate. A lubricant of the same general quality as in Example M was obtained.

Example N

The composition for this example was the same as for the initial composition of Example L, except that a liquid mixture of oligomers of 1-decene was substituted for the mixture of methyl esters that made up the major component of Example L. This composition was a clear, high quality, sling-resistant lubricant without the need for any addition of water such as was used in Example L.

Example O

The base lubricant for this composition consisted of 72.0 wt % of esters of pelargonic acid with alcohols made by condensing methanol with an average of 385 mol EO per mol of methanol, 11.7 wt % of butyl stearate, 6.3 wt % of a randomly alkoxylated butanol with an average molecular weight of about 4,400 (UCON™ 50-HB-5100 from Union Carbide Corp.), and 10.0 wt % of styrenated phenol condensed with an average of 9 mol of EO per mole of phenol. An amount of the emulsion prepared according to Example 1.9 above, equal to 1 wt % of the base lubricant, was added to a sample of the base lubricant, and the mixture allowed to stand for 24 hr. The mixture was hazy but remained homogeneous and suitable for use as a sling-resistant textile lubricant, with excellent lubricating effect.

Example P

For this example, the initial lubricant consisted entirely of esters of pelargonic acid with alcohols made by condensing methanol with an average of 300 moles of EO per mole of methanol. An amount of the emulsion prepared according to Example 1.9 above, equal to 1 wt % of the base lubricant, was added to a sample of the base lubricant, and the mixture allowed to stand for 24 hr. The mixture was then slightly hazy but remained homogeneous and suitable for use as a sling-resistant textile lubricant, with excellent lubricating effect.

Example Q

For this example, the base lubricant consisted entirely the products of condensing commercial grade lauric acid with an average of 9 mol EO per mol of acid. An amount of the emulsion prepared according to Example 1.9 above, equal to 1 wt % of the base lubricant, was added to a sample of the base lubricant, and the mixture allowed to stand for 24 hr. The mixture was then slightly hazy but remained homogeneous and suitable for use as a sling-resistant textile lubricant, with excellent lubricating effect.

What is claimed is:

1. A textile lubricant having enhanced sling resistance consisting essentially of:

(I) from 30–97 wt % of water-insoluble smoothing agents selected from the group consisting of mineral oils; carboxylic acid esters prepared from aliphatic carboxylic acids with 8–22 C atoms and straight and branched chain, optionally alkoxylated, alkyl alcohols with 1–22 C atoms; silicones; and polyalkylene glycols;

(II) from 0.001–2 wt % of a component selected from polymers that have limiting viscosities, measured in tetrahydrofuran at 20° C., of at least about 200 mL/g and that can be made by addition polymerization of a mixture of monomers selected from the group consisting of:

A. from 100—about 30 wt % of esters of acrylic acid and methacrylic acid with monohydric saturated aliphatic alcohols which contain from 1–22 C atoms; and B. up to about 70 wt % of monomers selected from the group consisting of:

(1) unsaturated aliphatic carboxylic acids with 3–5 C atoms and their amides, (2) styrene and alkylstyrenes with 1–4 C atoms in their alkyl residues, (3) acrylonitrile, (4) vinyl esters of aliphatic $C_{1-18}$ carboxylic acids, and (5) amino substituted esters of acrylic acid and methacrylic acid with monohydric alcohols having from 2–6 carbon atoms;

(III) from 0.5–69.997 wt % of a component selected from the group consisting of water-soluble smoothing agents selected from the group consisting of carboxylic acid esters prepared from aliphatic carboxylic acids with 8–22 C atoms and straight and branched chain, optionally alkoxylated, alkyl alcohols with 1–22 C atoms; and polyalkylene glycols, anionic, cationic, and nonionic surfactants, pH regulators, thread closing agents, bactericides, and anticorrosives; and (IV) from 0.0015–67 wt % water.

2. A textile lubricant according to claim 1, wherein said mixture of monomers contains about 100-40 wt % from group A and 0—about 60 wt % from group B.

3. A textile lubricant according to claim 2, wherein all the monomers from group A in said mixture of monomers are esters with alcohols having no more than about 12 carbon atoms in the alcohol.

4. A textile lubricant according to claim 1, wherein all the monomers from group A in said mixture of monomers are esters with alcohols having no more than about 12 carbon atoms in the alcohol.

5. A textile lubricant according to claim 4, wherein all the monomers from group B in said mixture of monomers are unsaturated carboxylic acids containing from 3 to about 5 carbon atoms.

6. A textile lubricant according to claim 3, wherein all the monomers from group B in said mixture of monomers are unsaturated carboxylic acids containing from 3 to about 5 carbon atoms.

7. A textile lubricant according to claim 2, wherein all the monomers from group B in said mixture of monomers are unsaturated carboxylic acids containing from 3 to about 5 carbon atoms.

8. A textile lubricant according to claim 1, wherein all the monomers from group B in said mixture of monomers are unsaturated carboxylic acids containing from 3 to about 5 carbon atoms.

9. A textile lubricant according to claim 8, wherein said polymers have limiting viscosities, measured in tetrahydrofuran at 20° C., of at least 600 mL/g.

10. A textile lubricant according to claim 7, wherein said polymers have limiting viscosities, measured in tetrahydrofuran at 20° C., of at least 600 mL/g.

11. A textile lubricant according to claim 6, wherein said polymers have limiting viscosities, measured in tetrahydrofuran at 20° C., of at least 600 mL/g.

12. A textile lubricant according to claim 5, wherein said polymers have limiting viscosities, measured in tetrahydrofuran at 20° C., of at least 600 mL/g.

13. A textile lubricant according to claim 4, wherein said polymers have limiting viscosities, measured in tetrahydrofuran at 20° C., of at least 600 mL/g.

14. A textile lubricant according to claim 3, wherein said polymers have limiting viscosities, measured in tetrahydrofuran at 20° C., of at least 600 mL/g.

15. A textile lubricant according to claim 2, wherein said polymers have limiting viscosities, measured in tetrahydrofuran at 20° C., of at least 600 mL/g.

16. A textile lubricant according to claim 1, wherein said polymers have limiting viscosities, measured in tetrahydrofuran at 20° C., of at least 600 mL/g.

17. A textile lubricant according to claim 1, containing (i) at least 0.02 wt % of a silicone component having a viscosity at room temperature in the range from 5 to 70 centistokes, said silicone component consisting essentially of molecules having molecular structures conforming to the general chemical formula I:

(I)

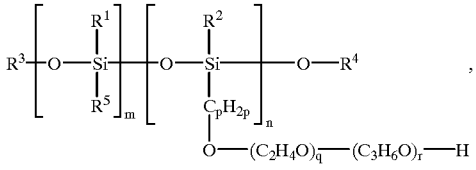

wherein each of $R^1$, $R^2$, $R^3$, $R^4$, and $R^5$ is a monovalent alkyl moiety having from 1 to 18 carbon atoms; m is a positive integer; p is 2 or 3; each of n, q, and r independently is zero or a positive integer; and each of the molecular blocks having the subscripts m, n, q, and r may be repeated, optionally with different values for the subscripts, in the actual structure of a molecule, with the blocks having the subscripts m and n optionally being randomly intermixed with each other in the backbone of the polymer and the blocks having the subscripts q and r optionally being randomly intermixed with each other in any polyether side chains that are present; and (ii) a sufficient amount of total basic constituents to at least neutralize any acidic ingredients present, said sufficient amount of total basic constituents including a sufficient amount of an amine component consisting essentially of one or more amines having an HLB value of not more than 8 to prevent any visually detectable gravitational segregation of two or more liquid phases in the total lubricant composition.

18. A textile lubricant according to claim 17, wherein component (i) has a viscosity between about 10 and about 54 centistokes; the lubricant comprises at least 0.05 wt % of molecules conforming to general formula I when each of $R^1$, $R^3$, $R^4$, and $R^5$ represents a methyl group and n=0; and the lubricant comprises at least about 1 wt % of amines having an HLB value of not more than about 5.7.

19. A textile lubricant according to claim 18, wherein the component (i) has a viscosity between about 20 and about 50 centistokes and the lubricant comprises at least about 2.5 wt % of a mixture of amines made by condensing tallow amines with an average of about 2 moles of ethylene oxide per mole of amine and at least 1 wt % of one or more partial esters of phosphoric acid.

20. A process for increasing the sling resistance of a textile lubricant by incorporating polymers therein, wherein the improvement comprises adding to said textile lubricant, at a temperature between about 15 and about 80° C. with agitation, an aqueous dispersion consisting essentially of water and of polymers that have limiting viscosities, measured in tetrahydrofuran at 20° C., of at least about 200 mL/g and that can be made by addition polymerization of a mixture of monomers selected from the group consisting of:

A. from 100—about 30 wt % of esters of acrylic acid and methacrylic acid with monohydric saturated aliphatic alcohols which contain from 1–22 C atoms; and B. up to about 70 wt % of monomers selected from the group consisting of:
   (1) unsaturated aliphatic carboxylic acids with 3–5 C atoms and their amides,
   (2) styrene and alkylstyrenes with 1–4 C atoms in their alkyl residues,
   (3) acrylonitrile,
   (4) vinyl esters of aliphatic $C_{1-18}$ carboxylic acids, and
   (5) amino substituted esters of acrylic acid and methacrylic acid with monohydric alcohols having from 2–6 carbon atoms, to produce a final textile lubricant consisting essentially of:

(I) from 30–97 wt % of water-insoluble smoothing agents selected from the group consisting of; carboxylic acid esters prepared from aliphatic carboxylic acids with 8–22 C atoms and straight and branched chain, optionally alkoxylated, alkyl alcohols with 1–22 C atoms; silicones; and polyalkylene glycols;

(II) from 0.001–2 wt % of said polymers that have limiting viscosities, measured in tetrahydrofuran at 20° C., of at least about 200 mL/g;

(III) from 0.5–69.997 wt % of a component selected from the group consisting of water-soluble smoothing agents selected from the group consisting of carboxylic acid esters prepared from aliphatic carboxylic acids with 8–22 C atoms and straight and branched chain, optionally alkoxylated, alkyl alcohols with 1–22 C atoms; and polyalkylene glycols, anionic, cationic, and nonionic surfactants, pH regulators, thread closing agents, bactericides, and anticorrosives; and (IV) from 0.0015–67 wt % water.

* * * * *